United States Patent [19]

Antesberger

[11] 4,218,912

[45] Aug. 26, 1980

[54] BALLISTIC DRIVE SYNCHRONIZER

[75] Inventor: Edward A. Antesberger, Fairfax, Va.

[73] Assignee: The United States of America as represented by the Secretary of the Army, Washington, D.C.

[21] Appl. No.: 1,332

[22] Filed: Jan. 5, 1979

[51] Int. Cl.[3] ..... G01M 13/02

[52] U.S. Cl. ..... 73/1 E; 73/162

[58] Field of Search ..... 89/41 R; 73/1 E, 162, 73/167; 33/1 N, 1 PT

[56] References Cited

U.S. PATENT DOCUMENTS

| | | | |
|---|---|---|---|
| 2,794,337 | 6/1957 | Palsson | 73/1 E |
| 2,804,594 | 8/1957 | Bjong | 73/1 E |
| 2,856,770 | 10/1958 | Palsson | 73/162 |

*Primary Examiner*—S. Clement Swisher

*Attorney, Agent, or Firm*—Nathan Edelberg; Robert P. Gibson; John E. Holford

[57] ABSTRACT

A method and apparatus is provided to measure and adjust the tracking error between a computer controlled ballistic drive mechanism such as is used on the main gun of the U.S. Army's main battle tank and its sight mechanism.

5 Claims, 1 Drawing Figure

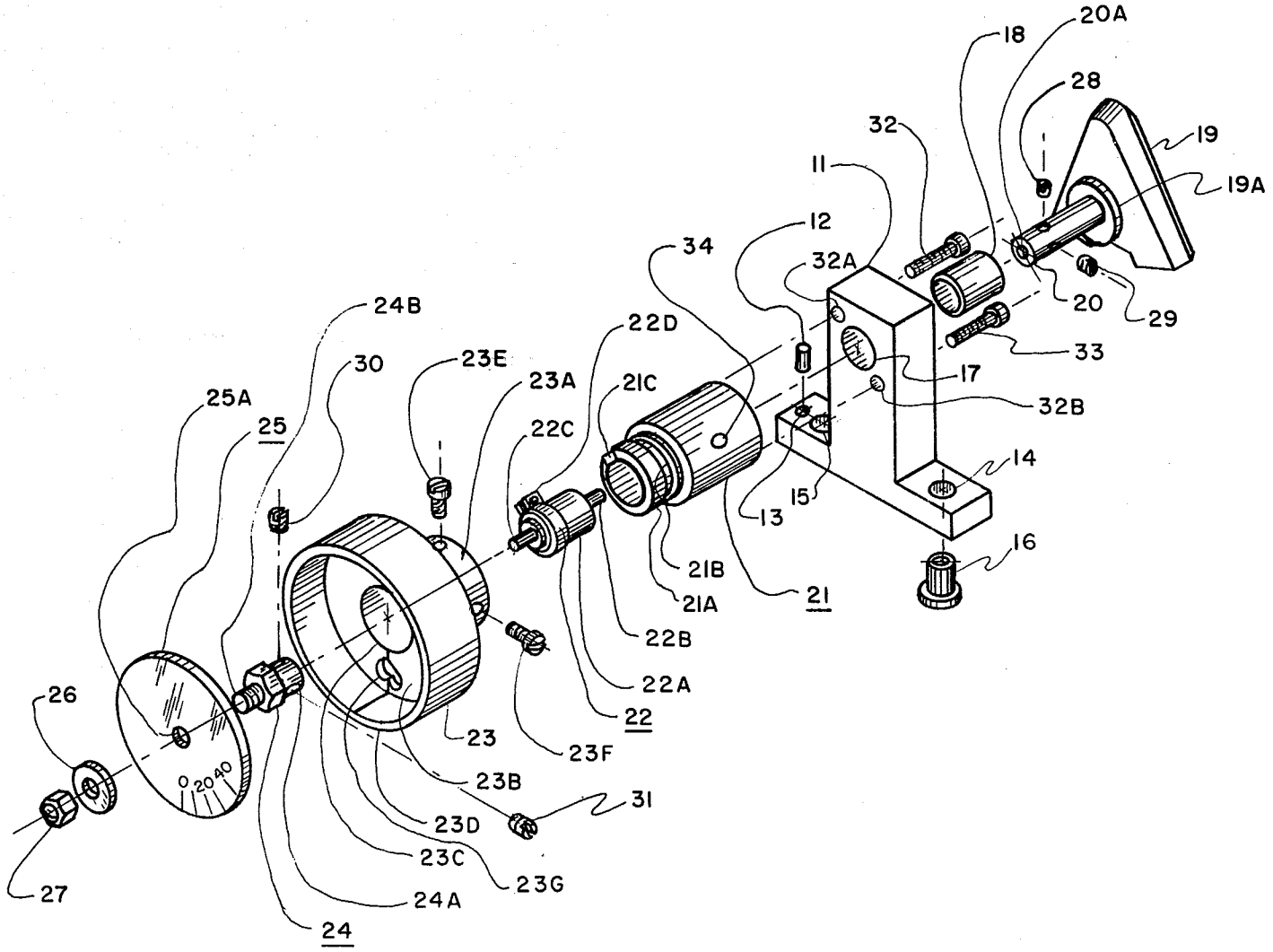
19
19A
29
20A
28
20
33
18
32B
14
16
17
32
11
12
32A
15
13
21
34
21B
21A
22B
22A
22D
21C
22
31
23F
23A
22C
23G
23E
23
23B
23D
23C
24A
24B
30
24
25
25A
26
27

BALLISTIC DRIVE SYNCHRONIZER

The invention described herein may be manufactured, used, and licensed by the U.S. Government for governmental purposes without the payment of any royalties thereon.

BACKGROUND OF THE INVENTION

The ballistic drive mechanism for the main gun of the Army's main battle tank is a complicated and precise mechanism. It includes tightly controlled electric and hydraulic servo-systems tied to a computer into which are fed a number of control variables such as target range, type of round, etc. The sighting mechanism is also complex to meet the requirements of operating safely within the armor of the vehicle and the ability to search out long range targets under conditions of restricted visibility, e.g. at night. Current sights may weigh between fifty and one hundred pounds and couple to the ballistic drive system with tolerances less than a thousandth of an inch.

Installing a sight and correlating it with its drive systems has proved to be very difficult. It may take as long as two hours for two or three men to mount the sight properly and much longer to synchronize it with the ballistic drive. The latter is generally accomplished for gun elevations from five degrees below horizontal to fifteen degrees above. Standard procedure is to position the fifty-seven ton vehicle on a vertically curved ramp and sight the target 1200 meters away through the gun barrel as the tank backs up the ramp. The tank stops at intervals while the tracking of the sight is checked and adjusted. If the sight fails to track, due to excessive backlash or the like, the ballistic drive mechanism arms are lengthened or shortened by screw and cam adjustments after which the whole procedure is repeated. The cost in time, manpower and energy is obviously excessive.

BRIEF DESCRIPTION OF THE INVENTION

An object of the invention is, therefore, to provide a method of detecting and measuring any backlash or the like in the above mentioned drive and sight systems which will prevent tracking of the two without having to install the sight itself. A further object is to provide a method of synchronizing the sight and the drive system which can be accomplished by anyone having ordinary mechanical skill in the art with little or no training, and which is accomplished without moving the tank (requiring a ramp to hold sixty tons), without using a qualified tank driver, and without using a target 1200 meters away. An additional object is to provide an apparatus to facilitate the performance of these methods.

BRIEF DESCRIPTION OF THE DRAWING

The above and other objects of the invention are best understood with reference to the drawing wherein is shown an exploded view of an apparatus to measure backlash and/or angular motion imparted to a gunsight or the like by a ballistic drive system.

DESCRIPTION OF THE INVENTION

The sight for the main gun of the main battle tank is mounted beneath a small rectangular window in the turret. It presents a small target to snipers and is further protected in that the only part directly visible is a small mirror which rotates with the turret and main gun horizontally and tracks with the gun barrel vertically. The sight structure includes a ballistic shield around the window behind which is the vertically moveable head mirror. The ballistic drive mechanism mounted in the turret provides a female half of a two part Oldham-like coupling which mates with a male part of the same coupling on the sight mechanism for controlling the vertical movement of the sight head mirror.

The drawing figure shows a test apparatus or Ballistic Drive Synchronizer which can be mounted in place of the tank sight for the purpose of carrying out the methods previously mentioned. The apparatus is mounted on a base support member 11, which like other portions of the apparatus is made of aluminum or magnesium alloy (unless otherwise specified) making it lightweight and easy to machine. The base support as shown is shaped like an inverted tee, the lower arms of the tee forming two mounting feet or lugs and the upstanding stem carrying the remaining parts of the apparatus. A first of the lugs carries a steel pin 12 force fitted into a blind hole 13 in the top of the lug. This pin is steel to maintain the tight tolerance of a mating hole in the mounting bracket for the sight mentioned above. Two holes 14 and 15 are drilled one through each of the lugs to mate with similar threaded holes in the mounting bracket appropriately spaced from the hole in which pin 12 is to be inserted. These holes receive steel grommets 16 which are force fitted therein to prevent erosion of the softer base material. A large hole 17 is drilled through the upper end of the stem of the base support normal to the T-shaped faces thereof. A sleeve type 18 Oilite bearing fits snugly into this hole, again to prevent wearing of the base material. The male half 19 of an Oldham-like coupling identical to that carried by the tank sight and having an identically positioned shaft 20 is mounted with the shaft passing snugly but rotatably through the sleeve 18. A boss on the male coupling having a diameter about equal to the width of the stem provides adequate clearance (about 1/16") between these parts. The position of the hole 17 is selected to place the shaft axis in the same position as the equivalent shaft on the sight when the base is mounted on the sight bracket. The T-shaped face is roughly 4 inches wide and 3½ inches tall overall. The lug portion of the face is ½ inch tall and the stem portion is about 1½ inches wide. The thickness normal to this face is about 1 inch.

On the opposite side of the base support are a series of coaxially aligned generally cylindrical members aligned with shaft 20. There is a toroidal spacing tube 21 having a substantial wall thickness (e.g. 3/16"), the outer diameter of which is reduced to form a step 21A at the end remote from the stem of the base support. The same diameter is reduced again in the center of the step to form a retaining groove 21B. An anti-rotation slot 21C is milled axially through the wall of the reduced portion for a gear mechanism.

Gear mechanism 22 is a standard reduction gear designed for low torque instrumentation use, such as a model T-9102 type made by the Sterling Instrument Division of Designatronics, Minoala, New York. The gear train is incased in a round tubular outer housing 22A from the opposite ends of which project the axially aligned low speed and high speed drive shafts 22B and 22C respectively. A band or clamp 22D tightly surrounds the end of the housing near the high speed shaft and terminates in upstanding coupled tabs which slide into slot 21C. If the housing is allowed to rotate it provides a differential action that prevents power transfer between the shafts. This unit is formed of steel and lightweight plastic.

A toroidal dial housing 23 is provided which has a reduced outer diameter collar 23A at the axial end near the spacing tube. This collar terminates at its opposite end in a washer shaped wall 23B, both of which have an internal diameter which mates snugly but slideably with the reduced end portion 21A of the spacing tube. The end of the washer shaped wall adjoins a cylindrical wall 23D projecting coaxially opposite to the collar and defines with the washer shaped wall a zero indicator 23G which may be a line in one axial plane, a point or a small pointer shaped window drilled through the washer shaped wall. A number of set screws like screws 23E and 23F are mounted in holes drilled and tapped through the collar 23A to mate with groove 21B in the spacer tube when the collar and tube fully overlap.

A dial assembly consisting of members 24–27 fits within the dial housing 23. A dial mounting adapter 24 has a hexagonal central cross-section shaped like a standard threaded nut which can be gripped by a standard end wrench. The end portion 24A near the gear mechanism preferably has a reduced outer diameter and must have a blind axial hole (not shown) to receive the shaft 23A of the gear mechanism in a snug axially slideable relationship. Alternatively this shaft and hole may have mating threads or they may be keyed to prevent relative axial rotation. The opposite end 24B of the adapter has a substantially reduced outer diameter which is preferably threaded. A rigid indicia plate 25 of lightweight material such as aluminum or a clear plastic is provided with center hole 25A which fits snugly and slideably over the substantially reduced end of the adapter. The indicia plate is thinner than the axial dimension of the adjacent cylindrical wall projecting from the washer-shaped wall 23B and slightly smaller in diameter than the inner diameter thereof so that it can rotate freely inside of that wall. The plate is provided with numbered equal angularly spaced makings to represent artillery range mil units. These may be placed on either or both sides of the plate depending on the type of plate and/or the position of the observers eye. The numbers are smaller than the angular spacing as determined by the gear ratio, e.g. 10:1, 20:1 or 100:1. The latter would require more than one rotation of the plate to measure 20° and necessitate overlapping scales. Washers like washer 26 are provided to as needed on either side of the plate to evenly distribute pressure as a nut 27 is tightened on the end portion 24B of the adapter, and to correctly position the plate in the plate housing.

The overall axial length of the unit is about 4¾ inches. Coupling member 19 uses about ½ inch of this dimension. The spacer tube has an outer diameter (O.D.) of about 1½ inches, not including its portion of reduced diameter. The plate housing with an O.D. of 1¾ inches uses another 1½ inches of axial dimensions. These dimensions may vary depending on the gear mechanism and readout mechanisms employed.

To assemble the unit the following procedure is followed. The pin 12, grommets 16 and bearing 18 are first pressed into the base support. Spacer tube 21 is then mounted using screws 32 and 33 which project through holes 32B and 33B in the stem of the base support 11 and engage blind tapped axially parallel holes (not shown) in the wall of tube 21. Set screws 28 and 29 are then threaded into tapped holes provided in the shaft 20, which screws are short enough to recess entirely within the shaft when fully inserted. The shaft 20 is then inserted through the stem of the base support. The screws are sequentially aligned with hole 34 through which a screwdriver is inserted to retract the screws enough to clear the axial aperture 20A in the shaft which extends normal to slightly beyond them. The clamp 22D is then mounted on the gear mechanism and the shaft 22B thereof inserted into aperture 20A and secured by screws 28 and 29. The adapter 24 is then mounted on the shaft 22C of the gear mechanism and secured with set screws 30 and 31. The plate housing can now be placed over the reduced end portion 21A of the spacer tube and secured by set screws 23E and 23F. It then remains only to assemble the plate with washers 26 and 27. The cylindrical wall or collar of the plate housing may be slotted or relieved to admit a thin end wrench for the central portion of the adapter. Alternatively a hole may be provided for an allen head screw driver to engage like sockets in the adapter set screws to permit removal of the adapter without removing the plate or plate housing. The coefficient of friction between the plate 25 and washer 26 preferably should be great enough to prevent accidental slippage when the shaft 22C is accelerated but small enough to permit manual adjustment of the plate to its zero position. Also the plate, plate housing and adapter may be replaced with an electrical transducer and digital readout, if desired, many versions of which are now commercially available.

The following method using the above described apparatus may be used to synchronize the movements of the main gun on the main battle tank with the movement of its sight mechanism, even though the latter may not be available.

A. The sight, if present, is removed. It is a great advantage of the present invention that the sight need not be present. This means that the ballistic drive system can be installed and checked out by one manufacturer and the sight by another.

B. A Gunners Quadrant (MIAI), which has a level and evaluation angle indicator calibrated in artillery mils, is mounted on the breech at the usual location points marked thereon.

C. The main gun is leveled by the powered hydraulic system, if the engine is running, or manually through the ballistic drive and the quadrant level with the angle indictor set at zero mils.

D. The Ballistic Drive Synchronizer (BDS) is next mounted firmly on the sight bracket with its half of the Oldham-type coupler inserted and locked onto the female half of that coupler carried by the ballistic drive.

E. The dial of the BDS is now rotated back and forth gently to measure any play due to misalignment of the sight bracket and the ballistic drive. If the play exceeds 0.2 mils the test is discontinued until the manufacturer or other responsible party corrects this deficiency.

F. If the play is within tolerance, the readout of the BDS is adjusted to zero.

G. The ballistic drive controls are set at zero (unity gain) and the drive is energized (or manually operated) to move the gun to position 268 mils above and 89 below the level position in increments of 89 mils as indicated by the gunners quadrant.

H. The initial readouts of the BDS are noted at each incremental position.

I. The course threaded control arms and/or the fine adjustment cams of the ballistic drive are then rotated clockwise or counterclockwise depending on whether the initial readouts are, respectively, less or greater than those of the gunners quadrant.

J. The gun is then elevated and depressed through the same equal increments above and below the level position and the steps H & I repeated until the readout of the BDS tracks that of the gunner's quadrant within 0.2 mils.

Thus adjusted, the gun and its sight will now track smoothly when the gun is moved through any angular range. The above tests are based on the tank being on an essentially level surface. This is not a requirement but the minimum of five or fifteen degrees may have to be adjusted to the range in which the rifle is restricted by an inclined surface. If both the BDS and the quadrant are equipped with electrical transducers to provide an electrical signal proportional to their readouts there are means readily available to display and or record the difference in these signals.

Many variations of the above methods and apparatus will be readily apparent to those skilled in the art, but the invention is to be limited only as encompassed by the following claims.

I claim:

1. In the process of installing a ballistic drive system for the main gun of a main battle tank, or the like; wherein said drive system includes a first half of an Oldham coupling to provide a variable angular adjustment of a mirror within a sight mounted on a bracket on the tank relative to angular adjustments provided for said main gun; the method of correllating said adjustments comprising the steps of:

substituting a ballistic drive synchronizer in place of said sight, said synchronizer having a base support means dimensional to exactly fit said bracket, a bearing in said base support means to accurately position a duplicate second half of an Oldham coupling in said first half and indicia plate means to measure the change of relative angular position between said second half and said base support; and manually rotating said second half successively in opposite directions to measure the play therebetween.

2. The method according to claim 1 further including the steps of:

setting the computer of the ballistic drive system to provide unity gain in the relative movement of said sight relative to said gun;

mounting a gunners quadrant on the breech of said gun;

leveling said gun with said quadrant;

referencing the reading of the vertical angle indicator of said quadrant with said indicia plate means; and rotating said gun and sight through said ballistic drive system in increments of 89 mils while recording the simultaneous angular readings of the quadrant and indicia plate means.

3. The method of claim 2 further including the steps of:

rotating the control arms and control arm adjustment cams when simultaneous readings differ by more than 0.2 mils to reduce said difference; and continuing to rotate said sight gun, control arms and cams until the sight and gun track with an error less 0.2 mils over a range of at least 356 mils.

4. A ballistic drive synchronizer for the main gun of a main battle tank having a ballistic drive system for said main gun which includes half of a two part Oldham coupling to drive the head mirror of a gun sight and a precisely positioned bracket mounted on said tank to hold said sight; said synchronizer comprising:

a base support member to precisely fit said bracket;

a bearing mounted in said support member to rotatably support a duplicate of the remaining half of said Oldham coupling in precisely the same relationship to said first coupling as required by a similar coupling on said sight; and calibrated means mounted between said support member and said coupling to measure the relative angular position therebetween.

5. A ballistic drive synchronizer according to claim 4 wherein said calibrated means includes:

means to multiply any angular change between said support means and said coupling.

* * * * *